United States Patent [19]

Garvert

[11] 4,375,405

[45] Mar. 1, 1983

[54] REFORMER CONTROL

[75] Inventor: Robert M. Garvert, Great Falls, Mont.

[73] Assignee: Phillips Petroleum Company, Bartlesville, Okla.

[21] Appl. No.: 200,288

[22] Filed: Oct. 24, 1980

[51] Int. Cl.[3] ..... C10G 35/04

[52] U.S. Cl. ..... 208/134; 208/139

[58] Field of Search ..... 208/134, 139, DIG. 1

[56] References Cited

U.S. PATENT DOCUMENTS

| | | | |
|---|---|---|---|
| 2,642,384 | 6/1953 | Cox | 208/139 |
| 2,642,385 | 6/1953 | Berger et al. | 208/138 |
| 2,917,454 | 12/1959 | Dennis | 208/134 |
| 3,248,320 | 4/1966 | White et al. | 208/136 |
| 3,448,036 | 6/1969 | Hayes | 208/139 |
| 3,573,199 | 3/1971 | McCoy | 208/139 |

*Primary Examiner*—Curtis R. Davis

*Attorney, Agent, or Firm*—French, Hughes and Doescher

[57] ABSTRACT

A hydrocarbon reforming process is controlled by manipulating the addition of halogen to the reforming catalyst responsive to an isopentane signal representative of the isopentane content in the reformate.

8 Claims, 2 Drawing Figures

Figure 1:
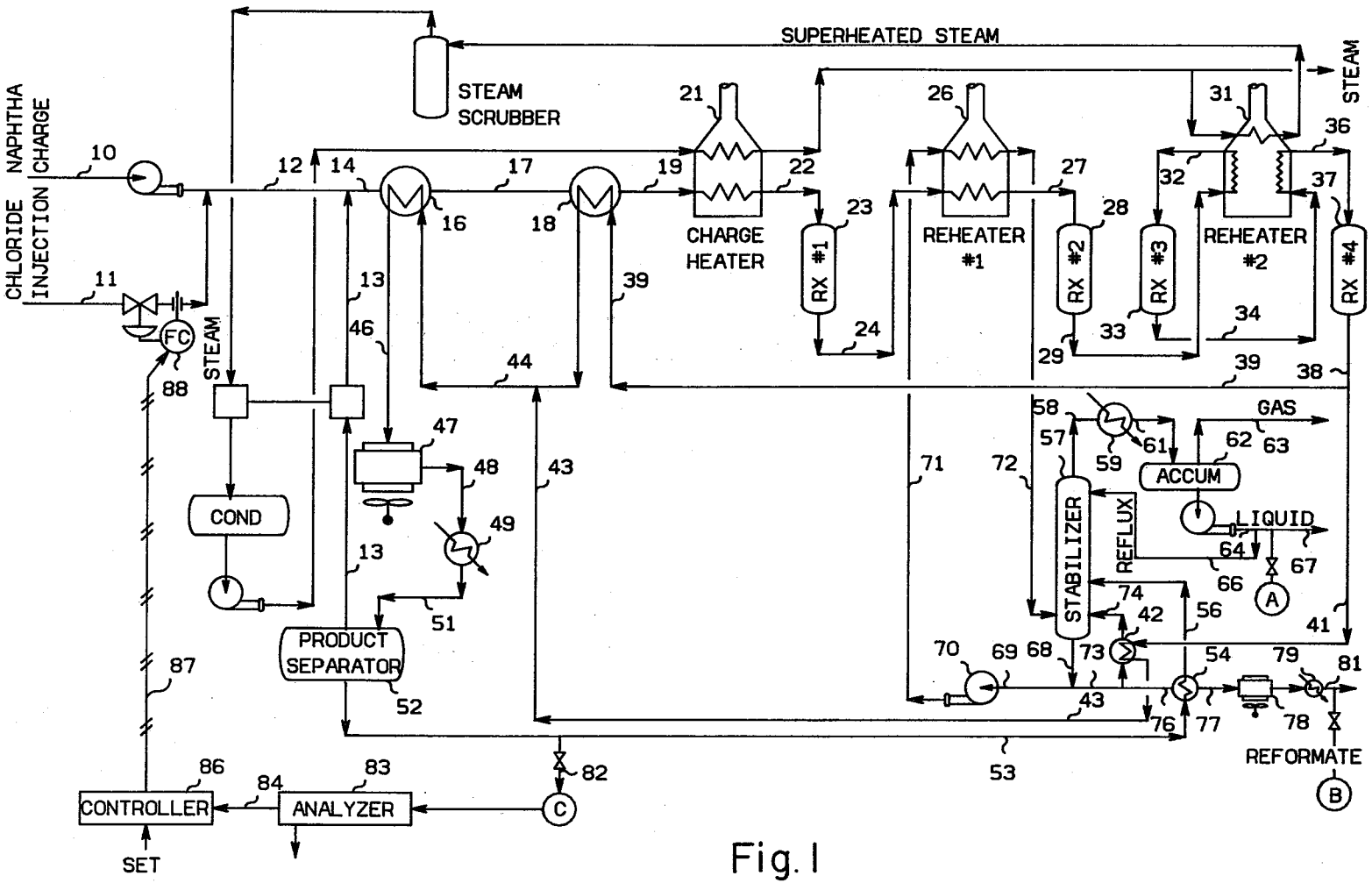

WT. % ISOPENTANE IN PRODUCT
5.0
4.0
3.0
A
B
C
D
E
F
II
101
102 (A)
102 (B)
102 (C)
102 (D)
102 (E)
102 (F)
METHANE FACTOR (WT. % METHANE IN TOTAL OF METHANE + ETHANE + PROPANE IN PRODUCT)
42
40
38
36
34
32
III
WT. RATIO OF PROPANE/METHANE IN PRODUCT
1.1
1.0
0.9
0.8
0.7
2
5
10
15
20
25
30
35
BARRELS FEED/LB. CATALYST (TIME) → (CATALYST LIFE)

REFORMER CONTROL

The present invention relates to the control of a catalytic reformer by manipulating the halogen addition to the reformer. In another aspect the invention relates to a catalytic hydrocarbon conversion process. Yet a further aspect of this invention is an apparatus for catalytic reforming.

BACKGROUND OF THE INVENTION

It is known in the art that octane values or antiknock properties of hydrocarbons can be improved by catalytic reforming process. There is a need to increase the antiknock quality of straight run and naphtha-type gasolines to obtain blending stocks for motor fuels, e.g., to blend with alkylate gasolines, and the like, to produce high octane motor fuels. Catalytic reforming is one method of increasing the octane values of these low antiknock hydrocarbons.

Usually the feedstocks to reforming are pretreated to remove catalyst poisons such as arsenic, sulfur, and nitrogen compounds, which extends considerably the life of the reforming catalysts.

Catalysts which are used in reforming can cause side-reactions, or undesired reactions when maximizing of gasoline is desired, such as hydrocracking. Higher pressure in the reformer will suppress hydrocracking, but higher pressure also suppresses dehydrogenation of the naphthenics and results in lower octane products. Currently used reforming catalysts include platinum-on-alumina, and multimetallic catalysts having platinum along with other metals such as rhenium. The prior art discloses many reforming catalysts.

Halogen, such as chloride, is desirable in the reforming operation to effect proper isomerization of low octane normal paraffins to higher octane isoparaffins. Too much chloride, however, causes too great an amount of hydrocracking which is, of course, not desired.

A number of reactions occur during reforming including dehydrogenation of naphthenics to aromatics, some of which aromatics are excellent petrochemical feed materials, with the major amount of aromatics being used as high octane gasoline components for blending into gasoline products. Other reactions occurring in reforming include cyclization of paraffinic hydrocarbons, which are then dehydrogenated to aromatics; isomerization of paraffinics; and hydrocracking which decreases the yield of gasoline and produces lighter hydrocarbons including methane, ethane, propane, butanes, and pentanes.

Hydrogen is a by-product of reforming (dehydrogenation occurs). Some hydrogen is recycled to reforming to sustain pressure and to mainly suppress coke formation (which results from hydrocracking). The net or yield hydrogen is available for use in hydrocracking, hydro-treating (hydrodesulfurization, hydrodenitrification), hydroisomerization, and to manufacture certain chemicals.

Since the halogen concentration in the reforming operation has a direct influence on the product composition, it would be desirable to have means to control the halogen content by manipulating halogen addition to the reformer responsive to the control signal. The faster the response of the control signal to a change in the halogen content is the more accurate the control can be and the more desirable the results achieved will be.

THE INVENTION

It is, thus, one object of this invention to provide a control for a reformer for adding halogen.

Another object of this invention is to provide a process to reform hydrocarbons while maintaining a desirable product composition close to a desired optimum.

A further object of this invention is an apparatus for controlled reforming.

Figure 2:
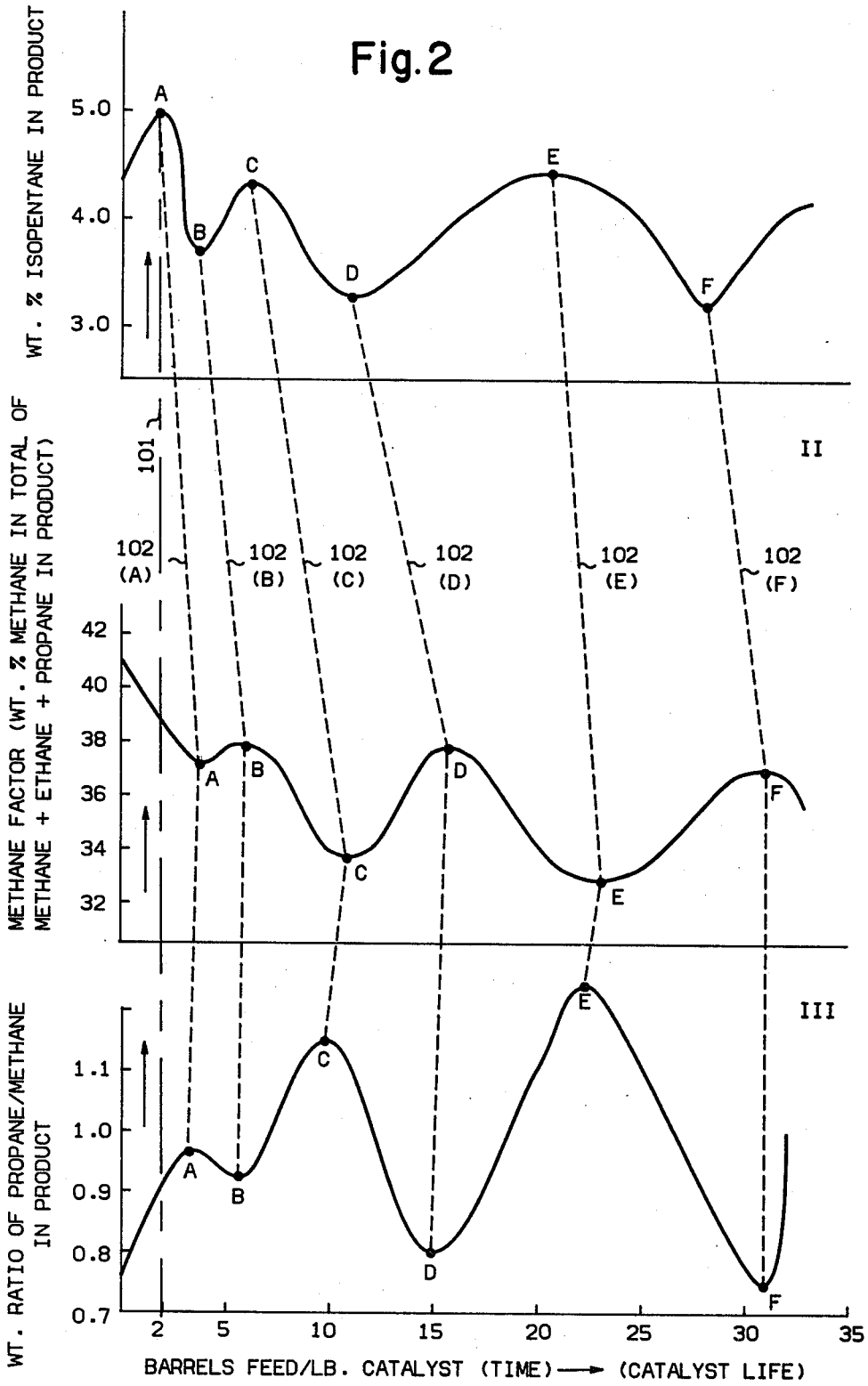

These and other objects, advantages, details, features and embodiments of this invention will become apparent to those skilled in the art from the following detailed description of the invention, the appended claims and the drawing in which FIG. 1 shows a schematic representation of a reforming unit, FIG. 2 shows diagrams illustrating the change of compositions of the reformed hydrocarbons versus barrels of feed per pound of catalyst (time).

In accordance with this invention it has been found that the isopentane content in the reformer effluent allows a faster control of the halogen addition than another method wherein the propane to methane ratio is utilized as the control signal.

In accordance with a first embodiment of this invention there is therefore provided a reformer control process. This process comprises automatically determining the isopentane content of the reformer product. An isopentane signal is automatically generated responsive to this determination and the rate of addition of the halogen is manipulated responsive to the isopentane signal. The determination of the isopentane content of the reformer product can be carried out at any location downstream of the reformer but is preferably carried out after the reformer effluent stream has been separated into a hydrogen rich gas stream and a liquid stream by measuring the isopentane content of this liquid stream.

The halogen is added to the reformer either continuously or discontinuously. It is presently preferred to add the halogen continuously and to control the flow of halogen into the reformer by a halogen flow controller and using the isopentane signal to adjust the set point of the halogen flow controller. The principle logic of the control system involved is such that the halogen addition is increased when the isopentane content decreased and conversely the halogen addition is decreased when the isopentane content increases.

Another embodiment of this invention resides in a catalytic hydrocarbon reforming process. In this reforming process a hydrocarbon feed stock is contacted under reforming conditions in a reformer with a reforming catalyst and halogen. The reformed hydrocarbon effluent is withdrawn from the reformer and the reformed effluent is separated into a plurality of product streams. In accordance with this invention this process is improved by controlling the halogen addition to the reformer responsive to the isopentane signal as described above. The hydrocarbon feed stream used in the reforming process of this invention has a relatively costant composition during the entire operation. Particularly the contents of paraffins in the hydrocarbon feed stream used in the reforming process is constant. The feed stocks used for catalytic reforming are usually those having a significant content of paraffins, naphthenes and only a small content of aromatics if any.

The reforming catalysts used in accordance with this invention are those that are influenced in their reforming activity by the presence or absence of halogen. These catalysts can also be characterized as causing excess hydrocracking when too much halogen is present and exhibiting decreasing hydrocracking activity when the halogen content of the catalyst is decreased. Examples of such catalysts are described in detail in U.S. Pat. Nos. 2,479,109; 2,479,110; 3,415,737, and 4,149,962, among many others, the disclosure of which is herewith incorporated by reference. The presently preferred catalysts are multimetallic catalysts particularly those containing platinum and other catalytically active metals such as rhenium.

The invention is particularly applicable to a process wherein the catalyst is employed in a fixed bed structure, i.e., in an operation wherein the catalyst during the process continuously looses activity until finally a point is reached where the catalyst has to be exchanged or regenerated. Such fixed bed operations are also well known in the art and described for instances in U.S. Pat. Nos. 2,479,110; 2,479,109; 2,642,384; 2,642,385; 3,573,199, among many others. The references mentioned above also describe typical operating conditions for a reforming process. Broadly the reforming is carried out at a temperature in the range of about 700° to about 1100° F. and under a pressure of about 50 to about 1000 psig; using a weight hourly space velocity (absent hydrogen) of about 0.5 to about 20 weights of hydrocarbon per weight of catalyst per hour; and a mol ratio of hydrogen to hydrocarbon of about 2 to 20.

Halogens selected from the group consisting of fluorine, chlorine, bromine and iodine can be used as such or in the form of compositions which release halogen under the reforming conditions. Examples of useful compounds, as are known in the art, include organic chlorides, hydrogen chloride, chlorine, organic fluorides, etc., and mixtures thereof.

In accordance with yet a further embodiment of this invention, an apparatus for reforming hydrocarbon feed stocks is provided for. This apparatus comprises a reformer having a hydrocarbon feed conduit, a halogen feed conduit and a reformate withdrawal conduit associated therewith. The apparatus in accordance with this invention is provided with an isopentane detector operatively connected with the reformer to detect the content of isopentane in the reformate and to generate an isopentane signal. A flow controller is provided in the halogen feed conduit. This controller is operatively connected to the detector such as to allow the manipulation of the halogen flow responsive to the isopentane signal.

The following description of the drawings and the specific examples are intended to further illustrate the invention without undue limitations of its scope.

In FIG. 1 naphtha feed 10, along with added chloride, e.g., 1,1,1-trichloroethane, injected at 11, is passed via conduit 12 into which the recycle hydrogen stream 13 is charged. This mass of naphtha, chloride, and hydrogen admixture is passed via conduit 14, indirect heater 16, conduit 17, indirect heater 18, and conduit 19 to charge heater (fired heater) 21. Effluent 22 from heater 21 is passed to the first reforming reactor 23. Effluent 24 from reactor 23 is passed to reheater 26, and the reheated mass is passed by conduit 27 to second reforming reactor 28. Effluent 29 from reactor 28 is reheated in reheater 31 and this mass is passed via conduit 32 to the third reforming reactor 33. Effluent 34 from reactor 33 is reheated in reheater 31 and this mass is passed by conduit 36 to the fourth reforming reactor 37. Effluent 38 from reactor 37 is divided; one portion is passed via conduit 39, for indirect feed heating, described hereinbelow, and a second portion is passed via conduit 41, reboiler 42, and conduit 43. The mass 39 indirectly heats the feed 17 in exchanger 18. This mass, partially cooled, is combined with stream 43 and the admixture is passed via 44 to indirectly preheat the feed in conduit 14 in exchange 16. This now cooler mass is passed via conduit 46, cooler (air-fin cooler) 47, conduit 48, indirect cooler 49 and conduit 51 to product separator 52. Hydrogen rich gas 13 is removed from separator 52 and compressed and recycled to feed conduit 14, as above described. Liquid product, reformate 53, is passed via exchanger, 54 wherein this mass is heated, and the mass is passed via 56 as feed to stabilizer 57. Overhead vapor 58 from stabilizer 57 is passed via cooler 59 and conduit 61 to overhead accumulator 62. Uncondensed components are removed at 63 for further use, as desired. Liquid from accumulator 62 is pumped by way of conduit 64, in part as liquid reflux 66 for stabilizer 57, and in part as light liquid product removed as a yield at 67 for further use, as desired.

Reformed naphtha is removed from stabilizer 57 via conduit 68, and, in part, is passed via conduit 69, pump 70, and conduit 71 to reheater 26. This heated mass is returned to the bottom (reboil) section of stabilizer 57 via conduit 72. Stream 73, reformed naphtha product, is, in part, passed to indirect exchanger 42 and back to the stabilizer 57 via conduit 74. The yield portion of reformed naphtha product is passed via conduit 76, indirect heat exchanger 54, conduit 77, (air-fin) cooler 78, indirect cooler 78, and yielded as product at 81.

Control of chloride injection is manipulated in response to the isopentane content of the product(s) of this system. Overhead liquid 67 can be analyzed at A for isopentane; reformed product 81 can be analyzed at B for isopentane, or, as shown in the drawing, liquid 53 from product separator 52 is charged at C via conduit 82 to conventional isopentane analyzer 83, and a signal 84, representative of the isopentane in conduit 53, is passed to conventional controller 86 wherefrom control signal 87 manipulates flow control unit 88 on chloride injection conduit 11.

In FIG. 2 three plots of the composition of the product of a reforming operation with respect to the time barrels of feed naphtha per pound of catalyst are shown. The three curves represent the composition of the same reformer effluent as follows:

I. weight percentage isopentane in product;

II. Methane Factor, which is weight percent methane of the methane plus ethane plus propane in the product; and III. ratio of weight percentage of propane to weight percentage of methane in product.

The reactor effluent 53 was analyzed for components including methane, ethane, propane, isobutane, normal butane, isopentane, and others, by weight percent of total stream.

Curve I relates isopentane weight percent of the product 53 at various on-stream times or catalyst life measured in barrels of feed naphtha per pound of catalyst;

Curve II relates the Methane Factor (methane factor is weight percent methane in the methane plus ethane plus propane in the product 53) at various on-stream times or catalyst life measured in barrels of feed naphtha per pound of catalyst; and Curve III relates the weight ratio of propane-to-methane in the product 53 at various on-stream times or catalyst life measured in barrels of feed naphtha per pound of catalyst.

The vertical line 101 in FIG. 2 passing through numeral 2 on the barrels of feed per pound of catalyst represents one sample of product 53 of which the above-listed components therein by weight percent were determined; that is, weight percent isopentane, methane, ethane, and propane were each determined on this sample and used to plot a single point on the proper curve I, II, or III.

It can be seen that at this 2 barrels of feed per pound of catalyst (time) that there is a maximum of about 5 on curve I for isopentane (isomerization), but that the minimum Methane Factor on curve II is about 38 and has not yet occurred; nor has the maximum for the weight ratio of propane-to-methane occurred on curve III, the value being about 0.9. These corresponding maxima and minima are tied by lines 102 a, b, c, d, e, and f, and one can observe the delay in using the Methane Factor (curve II) or the propane-to-methane weight ratio (curve III) rather than using the invention's weight percent isopentane (curve I) for control of the halide addition.

Reading the maximum c on curve I, the minimum c on curve II, and the maximum c on curve III, it can be seen that the maximum c of curve I (isopentane) occurs earlier in time than the corresponding minimum c on curve II and also earlier in time than the maximum c on curve III.

By using isopentane to control halide addition, e.g., 1,1,1-trichloroethane, an earlier correction can be made in the operation to prevent too much hydrocracking.

When (c) is reached, for example, the chloride injection is decreased; when (d) is reached, then chloride injection is increased. By using isopentane as the control, (c) and (d), as can be seen, are reached at an earlier point in time (curve I), than are (c) and (d) on curves II and III.

It has been found that by maintaining the isopentane weight percent of the product 53 at about 3.4 to about 4.2, an optimum operation results. This optimum is dependent upon catalyst type and catalyst life.

The set point on controller 86 (FIG. 1) is set at 3.8 weight percent isopentane in stream 53, and varies from about 3.4 minimum to about 4.2 maximum weight percent isopentane in stream 53. When isopentane quantity tries to go above 3.8, the rate of flow of chloride injection is decreased and when the isopentane quantity tries to go below 3.8, the rate of flow of chloride injection is increased. An increase in isopentane content requires a decrease in chloride injection and a decrease in isopentane requires an increase in chloride injection, within preselected control limits.

In the following specific example typical operating ranges and specific operating values as well as catalyst compositions and other conditions for the reforming are listed; these values are partially calculated.

(The reference numerals in parenthesis refer to the drawing).

Catalyst in Reactors

| | wt. % |
|---|---|
| Gamma Alumina, | 98.30 |
| Platinum, | 0.35 |
| Rhenium, | 0.35 |
| Chloride (as Cl), | 1.0 |

Feed Naphtha

Straight run naphtha from atmospheric distillation of crude oil boiling between about 200° F. (initial) and 400° F. (end point).

Isopentane Analysis

This could be weight percent or liquid volume percent.

Streams Analyzed (One of or more)

(a) Stabilizer Overhead Liquid (67)
(b) Product reformate (81)
(c) Liquid (53) from Product Separator (52) (the latter used herein to illustrate the invention)

Operating Conditions

| | Ranges | Specific |
|---|---|---|
| (23) Reactor #1: | | |
| Temperature In, °F., | 880–970 | 930 |
| Temperature Out, °F., | 810–900 | 830 |
| STP Gas Space Velocity, V/V/Hr., | 1–4 | 2.5 |
| Pressure, psig., | 100–450 | 275 |
| (28) Reactor #2: | | |
| Temperature In, °F., | 880–970 | 930 |
| Temperature Out, °F., | 810–900 | 860 |
| STP Gas Space Velocity, V/V/Hr., | 1–4 | 2.5 |
| Pressure, psig., | 100–450 | 270 |
| (33) Reactor #3: | | |
| Temperature In, °F., | 880–970 | 930 |
| Temperature Out, °F., | 855–950 | 905 |
| STP Gas Space Velocity, V/V/Hr., | 1–4 | 2.5 |
| Pressure, psig., | 100–450 | 265 |
| (37) Reactor #4: | | |
| Temperature In, °F., | 880–970 | 930 |
| Temperature Out, °F., | 865–975 | 917 |
| STP Gas Space Velocity, V/V/Hr., | 1–4 | 2.5 |
| Pressure, psig., | 100–450 | 260 |
| (57) Stabilizer: | | |
| Top temperature, °F., | 185 | Typical |
| Bottom temperature, °F., | 425 | |
| Pressure, psig., | 100 | |

Note:
V/V/hr. is volume of feed (gas) per volume of catalyst per hour.

Flow Rate

| Flow Rate | | |
|---|---|---|
| (10) Naphtha Charge: | | |
| Barrels/Hr., | 700 | Typical |
| (13) Hydrogen Stream: | | |
| (20 PPM by volume H O) SCF $H_2$/BBl Feed, | 1000 | Typical |
| (11) Chloride Injection: | | |
| (1,1,1 Trichloroethane) Typical, lbs/Hr., | (a) 0.2 | Typical |
| (81) Product Reformate: | | |
| Barrels/Hr., | 560 | Typical |
| RON Clear, | 93 | |

(a) This will vary depending on isopentane in product 53.
STP = Standard Temperature (60° F.) and Pressure (1 Atmosphere)

Reasonable variations and modifications will become apparent to those skilled in the art and can be made in this invention without departing from the spirit and scope thereof.

I claim:

1. Reformer control process comprising
   a. automatically determining the isopentane content of a reformer product,
   b. generating an isopentane signal responsive to this determination,
   c. manipulating the addition of halogen to the reformer responsive to said isopentane signal in such a way as to increase (decrease) halogen addition responsive to a decrease (increase) in isopentane content.

2. A process in accordance with claim 1 wherein halogen is added continuously, wherein the flow of halogen is controlled by a halogen flow controller, and wherein said isopentane signal is used to adjust the set point of said halogen flow controller so that for an isopentane content at or below an isopentane set point the flow of halogen is increased and conversely for an isopentane content above an isopentane set point the flow of halogen is decreased.

3. A process in accordance with claim 1 wherein a fixed quantity of halogen is added to the reformer catalyst whenever the isopentane signal indicates that the isopentane content of the reformer product has reached or fallen below an isopentane set point.

4. A process in accordance with one of the claims 1–3 wherein said halogen is chloride.

5. In a catalytic hydrocarbon reforming process wherein a hydrocarbon feed stream is contacted under reforming conditions in a reformer with a reforming catalyst and a halogen additive, a reformed hydrocarbon effluent is withdrawn from said reformer and said reformed hydrocarbon effluent is separated into a plurality of product streams, the improvement comprising
   a. automatically determining the isopentane content of a reformed hydrocarbon effluent,
   b. generating an isopentane signal responsive to this determination,
   c. controlling the addition of halogen to the reformer responsive to said isopentane signal in such a way as to increase (decrease) halogen addition responsive to a decrease (increase) in isopentane content.

6. A process in accordance with claim 5 wherein halogen is added continuously to said reformer, wherein the flow of halogen is controlled by a halogen flow controller and wherein said isopentane signal is used to adjust the set point of said halogen flow controller so that for an isopentane content at or below an isopentane set point the flow of the halogen is increased and conversely for an isopentane content above an isopentane set point the flow of halogen is decreased.

7. A process in accordance with claim 5 or 6 wherein a fixed quantity of halogen is added to the reformer catalyst whenever the isopentane signal indicates that the isopentane content of the effluent is at or below an isopentane set point.

8. A process in accordance with one of the claims 5–7 wherein said halogen is chloride.

* * * * *